US005710120A

United States Patent [19]

Kanluen et al.

[11] Patent Number: 5,710,120

[45] Date of Patent: Jan. 20, 1998

[54] NONSILICATED SOFT METAL SAFE PRODUCT

[75] Inventors: Ratana Kanluen, Canton, Mich.; Henry Scrivens, Herts; Angela Brett, London, both of England

[73] Assignee: Diversey Lever, Inc., Plymouth, Mich.

[21] Appl. No.: 647,194

[22] Filed: May 9, 1996

Related U.S. Application Data

[63] Continuation of Ser. No. 266,175, Jun. 27, 1994, abandoned.

[51] Int. Cl.[6] ..... C11D 1/72; C11D 1/94; C11D 3/20

[52] U.S. Cl. ..... 510/421; 510/422; 510/423; 510/427; 510/432; 510/433; 510/434; 510/435; 510/499; 510/501; 510/508

[58] Field of Search ..... 510/421, 422, 510/423, 427, 432, 433, 434, 435, 499, 501, 508

[56] References Cited

U.S. PATENT DOCUMENTS

| | | | |
|---|---|---|---|
| H468 | 5/1988 | Malik et al. | 252/542 |
| 2,882,134 | 4/1959 | Spring et al. | 41/42 |
| 2,882,135 | 4/1959 | Elliott, Jr. | 41/42 |
| 3,017,355 | 1/1962 | Oakes | 252/8.55 |
| 3,077,154 | 2/1963 | Jullien-Davin | 95/64 |
| 3,107,221 | 10/1963 | Harrison et al. | 252/148 |
| 3,653,095 | 4/1972 | Dupre et al. | 21/2.7 |
| 3,676,354 | 7/1972 | Kaneko et al. | 252/147 |
| 3,802,890 | 4/1974 | Keeney | 106/14 |
| 3,932,303 | 1/1976 | Hollingshad | 252/389 |
| 4,000,679 | 1/1977 | Norman | 84/464 |
| 4,147,652 | 4/1979 | Kaniecki | 252/156 |
| 4,229,409 | 10/1980 | Scharf et al. | 422/13 |
| 4,230,592 | 10/1980 | Miller et al. | 252/156 |
| 4,240,921 | 12/1980 | Kaniecki | 252/156 |
| 4,370,250 | 1/1983 | Joshi | 252/135 |
| 4,370,256 | 1/1983 | Oakes | 252/391 |
| 4,452,758 | 6/1984 | Wilson et al. | 422/15 |
| 4,613,449 | 9/1986 | Dingess | 252/174.17 |
| 4,787,999 | 11/1988 | Dingess | 252/174.17 |
| 4,976,885 | 12/1990 | Wisotzki et al. | 252/174.17 |
| 5,244,593 | 9/1993 | Roselle et al. | 252/99 |
| 5,294,364 | 3/1994 | Thomas et al. | 252/142 |

FOREIGN PATENT DOCUMENTS

| | | |
|---|---|---|
| 1097491 | 3/1981 | Canada . |
| 0254653 | 1/1988 | European Pat. Off. . |
| 1937841 | 3/1970 | Germany . |
| 1558652 | 1/1980 | United Kingdom . |
| WO92/08777 | 5/1992 | WIPO . |

*Primary Examiner*—Paul Lieberman
*Assistant Examiner*—Gregory R. Delcotto
*Attorney, Agent, or Firm*—A. Kate Huffman

[57] ABSTRACT

Stable, silicate-free, soft metal safe, alkaline cleaners are provided. The cleaners comprise calcium ions and surfactants containing hydroxyl and/or carboxylic acid groups or a combination thereof, wherein the total of the two functionalities in each surfactant is greater than or equal to 2, and alpha-hydroxy carboxylic acids. It has been surprisingly discovered that alpha-hydroxy carboxylic acids such as tartaric acid, are capable of keeping calcium ions in an alkali solution. The cleaners may also comprise nonionic surfactants to provide wetting, detergency, and foamability where required, anionic surfactants as viscosity enhancers in the case of high retention cleaners, and solvents such as alcohols, glycol ethers, or hydrotropes to enhance solubility of the system. The alkaline cleaners are safe to use on soft metal surfaces and equipment commonly found in many industries, without the presence of silicate which is normally used as a corrosion inhibitor.

26 Claims, No Drawings

NONSILICATED SOFT METAL SAFE PRODUCT

This is a continuation of U.S. patent application Ser. No. 08/266,175, filed Jun. 27, 1994, now abandoned.

FIELD OF THE INVENTION

The present invention relates generally to stable, silicate-free, soft metal safe, alkaline cleaners and more particularly, to stable, silicate-free, soft metal safe, alkaline cleaners comprising calcium ions and surfactants containing hydroxyl and/or carboxylic acid groups, as well as alpha-hydroxy carboxylic acids.

BACKGROUND OF THE INVENTION

It is a common practice to use sodium silicate as a corrosion inhibitor in alkaline cleaners. Silicate, abundant and inexpensive to produce, provides soft metals such as aluminum and its alloys with effective protection against corrosion. Silicate also functions as a builder and detergent due to its affinity for clay and other inorganic soil particles. For silicate to act as an effective corrosion inhibitor in alkaline cleaners, the ratio of $SiO_2$:$Na_2O$ must be 1, which means that the causticity of alkaline cleaners is kept low. However, low alkaline cleaners do not sufficiently remove tenacious soils such as food soils. As a result, alkaline cleaners when formulated with silicate, have limited use due to their low causticity which restricts their use to light-duty cleaning only. Lowering the ratio of $SiO_2$:$Na_2O$ to less than 1 by increasing the causticity, renders the formulation aggressive and unsafe to apply to soft metal surfaces. Furthermore, silicated cleaners pose severe rinsing problems due to deposition of silicate film on metal surfaces. In addition, silicate deposition tends to increase on hot surfaces such as those encountered in food processing plants. Such deposits are unsightly and difficult to remove, and are therefore unacceptable in the food industry.

The principle of combining alkaline earth metal ions (e.g. $Ca^{2+}$, $Ba^{2+}$ and $Sr^{2+}$) with certain surface-active agents such as alkylpolyglucosides and/or amphoteric surfactants containing one or more amine groups, to inhibit the attack of hydroxide ion on alkali sensitive materials, has previously been reported in U.S. Pat. No. 3,653,095. Although the principle of the corrosion inhibiting system set forth in the '095 patent has proven to perform well for its intended purpose, it is difficult to introduce this mixture into alkaline cleaners which contain ingredients such as caustic, surfactants, and/or other builders, without inducing precipitation of hydroxides of alkaline earth metals, disturbing the stability of the cleaners or adversely affecting the effectiveness of the corrosion inhibiting system.

Theoretically, protection against corrosion is based on the presence of solvated alkaline earth metal ions which must be kept as such or the system will lose its effectiveness as a corrosion inhibitor, i.e. the formulation must not contain builder such as strong chelating agents (e.g. EDTA and its analogs) which could bind with the alkaline earth ions. In addition, alkaline earth metal ions such as $Ca^{2+}$ precipitate under alkaline conditions forming hydroxides such as calcium hydroxide, which is a white precipitate. Although it may be possible to keep the precipitate suspended in an alkaline formulation for a short period of time, eventually it will settle out and thus a long shelf life can not be achieved. There thus remains a need for stable, silicate-free, soft metal safe, alkaline cleaners.

SUMMARY OF THE INVENTION

The present invention provides stable, silicate-free, soft metal safe, alkaline cleaners for heavy-duty surface cleaning. The cleaners of the present invention comprise calcium ions, surfactants containing hydroxyl and/or carboxylic acid groups, wherein the total of the two functionalities in the surfactant is greater than or equal to 2, and alpha-hydroxy carboxylic acids. Corrosion inhibition depends on the presence of unchelated alkaline earth metal ions and therefore, it is essential that these metal ions be kept as such to maintain corrosion inhibition. It has been surprisingly discovered that alpha-hydroxy carboxylic acids such as tartaric acid, are capable of keeping calcium ions in an alkaline solution.

Other features and advantages of the present invention will become apparent from the following description and appended claims.

DETAILED DESCRIPTION OF THE PREFERRED EMBODIMENTS

A stable, silicate-free, soft metal safe, alkaline cleaner is provided. The cleaners of the present invention generally comprise a composition of calcium ions, surfactants containing hydroxyl and/or carboxylic acid groups, wherein the total of the two functionalities in the surfactant is greater than or equal to 2, and alpha-hydroxy carboxylic acids. It has been surprisingly found that alpha-hydroxy carboxylic acids are capable of keeping calcium ions in an alkaline solution. While not intending to be bound by theory, it is believed that the calcium ions, surfactants and alpha-hydroxy carboxylic acids act together to provide a protective film on soft metal surfaces, thereby achieving stable, soft metal safe, heavy-duty alkaline cleaners.

The composition of the present invention comprises from about 0.1% to about 0.5% calcium ion, from about 1.0% to about 10.0% surfactant containing carboxylic acid and/or hydroxyl groups, wherein the total of the two functionalities in the surfactant is greater than or equal to 2, and from about 0.5% to about 7% alpha-hydroxy carboxylic acid. (All percentages herein are percentages by weight, unless otherwise indicated). A preferred composition of the present invention comprises from about 0.2% to about 0.4% calcium ion, from about 3% to about 7% surfactant and from about 2% to about 4% alpha-hydroxy carboxylic acid.

The calcium ions of the present invention are preferably obtained from soluble calcium salts including but not limited to, calcium acetate and other non-corrosive calcium salts. The surfactant of the present invention is generally selected from the group consisting of alkylpolyglucoside surfactants where alkyl is C6 to C18, amphoteric surfactants containing one or two carboxylic groups and having a carbon chain of at least 10 carbon atoms and preferably having hydroxyl groups, polycarboxyl surfactants, polyhydroxyl surfactants and combinations thereof. In a preferred composition, the surfactant is a alkylpolyglucoside surfactant, amphoteric surfactant and/or combinations thereof. In addition, in a preferred composition, the alpha-hydroxy acid is a dicarboxylic acid where tartaric acid is most preferred.

In addition to the compounds set forth above, the composition of the present invention may also contain from about 4% to about 25% and preferably up to about 10% sodium hydroxide or potassium hydroxide and up to about 5%, preferably from about 1% to about 3% solvent such as alcohols, glycol ethers or hydrotropes such as xylene and toluene sulfonates. Additionally, up to about 5% and preferably from about 1% to about 3% nonionic surfactant may be added for foam enhancing, wetting and detergency. Examples of preferred nonionic surfactants include alcohol alkoxylates, alkylphenol alkoxylates, and amine oxides such as alkyl dimethylamine oxide or bis(2-hydroxyethyl) alkylamine oxide where alkyl is a straight chain HC of 10 to 18 carbon atoms, or a combination thereof with a HLB of at least about 11. In the case of high retention cleaners, to enhance foam and foam retention, up to about 5% and preferably from about 1% to about 3% anionic surfactant, tolerant to calcium ions may be added. Examples of suitable anionic surfactants include alkali metal salts of alkyl sulfates and alkyl ether sulfates where alkyl is at least C10 and the number of alkylene oxide groups is from 2 to 4.

Chemical structures of representative surfactants of the present invention are set forth below.

Alkylpolyglucoside Surfactants:

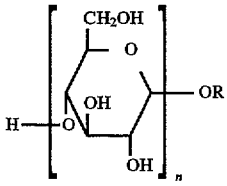

where R is a linear alkyl chain between C6 to C18 and n is the degree of polymerization (1.1–3).

Amphoteric Surfactants:

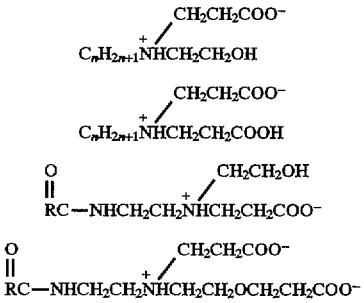

where n is 8 to 18.

Examples of suitable amphoteric surfactants include capryloamphopropionate, available under the tradename Monateric CYNA-50, disodium lauryl B-iminodipropionate, available under the tradename Monateric 1188M and cocoamphocarboxypropionate, available under the tradename Monateric CEM-38.

The cleaners of the present invention may be applied in the form of either foam or gel-like foam (high retention cleaners), depending on the type of surfactants present in the system. The cleaners described herein are to be used at concentration levels of about 1% to about 8% v/v, depending on the level and type of soils to be removed. In a preferred embodiment, the maximum working concentration should not exceed 8% v/v. In addition, the amount of solids in a preferred composition of the present invention is at least 15%. Moreover, in a highly preferred composition of the present invention, the corrosion rate at 4% w/w, does not exceed 0.1 mm/yr, under ASTM test method G-31, herein incorporated by reference.

It will be appreciated that the compositions of the present invention may be used in any appropriate cleaning situation including but not limited to industrial and institutional external cleaners, clean in place (CIP), bottle washing, pasteurizers, cooling water systems, hard surfaces cleaners, dishwashing and laundry. It will also be appreciated that the composition of the present invention may be varied according to the desired characteristics of the cleaning composition.

By "soft metal" as used herein is meant alkaline sensitive metals including but not limited to aluminum, zinc, tin, lead and alloys thereof, and siliceous compositions including but not limited to glass and porcelain. By "alkaline cleaners" as referred to herein is meant a cleaner having a causticity as $Na_2O$ of at least 3.0%. The standard for the term "stable" as used herein is meant stable, i.e. functional for its intended purpose, under the following conditions: room temperature for at least six months, 120° F. for at least one month, 40° F. for at least one month and freeze/thaw stable for at least three cycles.

The following examples will further illustrate the preparation and performance of the preferred compositions in accordance with the present invention. However, it is to be understood that these examples are given by way of illustration only and are not a limitation of the present invention. In the following examples, the term "part" or "parts" means parts by weight, unless otherwise noted.

EXAMPLE I

A mixture of 73.6 parts soft water, 1.0 part calcium acetate, 3.5 parts alkyl polyglucoside(alkyl=$C_6$–$C_{18}$, HLB=13.1), 3.0 parts tartaric acid, 16.5 parts sodium hydroxide (50% solution), and 2.4 parts myristyl dimethylamine oxide was mixed in a vessel equipped with an agitator. The ingredients must be added one at a time and mixed thoroughly before each addition. The finished product was a transparent and homogenous liquid.

EXAMPLE II

A mixture of 69.8 parts soft water, 1.0 part calcium acetate, 3.5 parts alkyl polyglucoside(alkyl=$C_6$–$C_{18}$, HLB=13.1), 3.0 parts tartaric acid, 16.5 parts sodium hydroxide (50% solution), 2.4 parts myristyl dimethylamine oxide, 1.8 parts sodium lauryl sulfate, and 2.0 parts dipropylene glycol methyl ether was mixed in a vessel equipped with an agitator in the same manner as in EXAMPLE I. The finished product was a clear and homogenous liquid.

EXAMPLE III

A mixture of 61.6 parts soft water, 1.0 part calcium acetate, 3.5 parts alkyl polyglucoside(alkyl=$C_6$–$C_{18}$, HLB=13.1), 3.0 parts tartaric acid, 25.0 parts potassium hydroxide (45% solution), 2.4 parts myristyl dimethylamine oxide, 1.5% sodium lauryl sulfate, and 2.0% dipropylene glycol methyl ether was mixed in a vessel equipped with an agitator in the same manner as in EXAMPLE I. The finished product was a clear and homogenous liquid.

EXAMPLE IV

A mixture of 73.2 parts soft water, 1.0 part calcium acetate, 3.0 parts tartaric acid, 18.0 parts sodium hydroxide (50% solution), 3.0 parts capryloamphopropionate, and 1.8 parts lauryl dimethylamineoxide was mixed in a vessel equipped with an agitator in the same manner as in EXAMPLE I. The finished product was a clear and homogeneous liquid.

EXAMPLE V

A mixture of 72.8 parts soft water, 1.2 part calcium acetate, 2.5 parts alkyl polyglucoside(alkyl=$C_6$–$C_{18}$, HLB=13.1), 3.0 parts tartaric acid, 16.0 parts sodium hydroxide (50% solution), 2.1 parts cocoamphodipropionate, and 2.4 parts lauryl dimethylamineoxide was mixed in a vessel equipped with an agitator in the same manner as in EXAMPLE I. The finished product was a clear and homogeneous liquid.

EXAMPLE VI

A mixture of 72.6 parts soft water, 1.0 part calcium acetate, 3.0 parts alkyl polyglucoside(alkyl=$C_6$–$C_{18}$, HLB=

13.1), 3.0 parts tartaric acid, 16.0 parts sodium hydroxide (50% solution), 2.0 parts polycarboxyl surfactant, and 2.4 parts lauryl dimethylamineoxide was mixed in a vessel equipped with an agitator in the same manner as in EXAMPLE I. The finished product was a clear and homogeneous liquid.

EXAMPLE VII

Corrosion Test Procedure:

Corrosion tests have been conducted according to ASTM method G-31. The test conditions were as follows:

Coupon dimension: 1"×3"×0.025"

Test solution: 4.0% w/w solution

Volume of test solutions: 800 ml

Temperature: ambient temperature

Test duration: 48 hours

Container: 32 oz wide-mouth French bottle, loosely capped

Position of test coupon: suspended in test solution

Two types of aluminum coupons were used for testing, SIC Grade (99.0% pure aluminum), the most commonly found aluminum alloy in Europe and A 3003 H14 (97.1% pure aluminum, bare surface), the most widely used general purpose aluminum alloy in North America.

Test Results:

In Table I, the aluminum coupon is SIC grade (99.0% pure aluminum). Table I shows corrosion rates of high alkaline (causticity as % $Na_2O$) cleaners of the present invention (the cleaners of Example I and II) and in comparison with that of a commercial, low alkaline cleaner.

TABLE I

| | Actives in the Concentrations | | | |
|---|---|---|---|---|
| Sample | Causticity as % $Na_2O$ | % $SiO_2$ | Corrosion inhibitors % $Ca^{2+}$/% APG* | Corrosion Rate mm/yr. |
| Example I | 6.1 | — | 0.25/3.5 | 0.028 |
| Example II | 6.1 | — | 0.25/3.5 | 0.031 |
| Commercial I | 3.5 | — | — | 11.07 |

*APG = alkylpolyglucoside

In Table II, aluminum coupon is A 3003 H14 (Q-Panel). Table II shows corrosion rates and surface appearance for cleaners of the present invention (the cleaners of Example II and III) in comparison with a commercial, silicated, soft metal safe cleaner.

TABLE II

| | % Actives in the Concentrates | | | Corrosion | |
|---|---|---|---|---|---|
| Sample | Causticity as % $Na_2O$ | % $SiO_2$ | Corrosion inhibiting system of this invention, % $Ca^{2+}$/% APG* | Corrosion Rate (mm/yr) | Appearance |
| Example II | 6.1 | — | 0.25/3.5 | 0.0135 | clean, shinny surface |
| Example III | 6.1 | — | 0.25/3.5 | 0.0165 | clean, shinny surface |
| Commercial I | 3.5 | — | — | 11.79 | brownish surface |
| Commercial II | 5.1 | 3.2 | — | 0.0545 | grayish with white film all over (silicate film) |

*APG = alkylpolyglucoside

In Table III, the aluminum coupon is A3003 H14 (Q-Panel). Table III shows corrosion rates and surface appearance for cleaners of the present invention (the cleaners of Examples IV and V) in comparison to commercial silicated cleaners.

TABLE III

| | | | Corrosion | |
|---|---|---|---|---|
| Sample | Causticity as % $Na_2O$ | Surfactant(s) used in conjunction with calcium ion | Corrosion Rate (mm/yr) | Appearance |
| Example IV | 6.6 | Capryloampho-propionate | 0.13 | clean, shinny surface |
| Example V | 5.9 | Cocoampho-dipropionate | 0.004 | clean, shinny surface |
| Commercial II | 5.1 | % $SiO_2$ = 3.2 | 0.141 | slightly grayish with white film |

The foregoing discussion discloses and describes merely exemplary embodiments of the present invention. One skilled in the art will readily recognize from such discussion, and from the accompanying claims, that various changes, modifications and variations can be made therein without departing from the spirit and scope of the invention as defined in the following claims.

All patents and references cited herein are specifically incorporated by reference.

We claim:

1. A stable, alkaline cleaner composition comprising;

a) from about 0.1% to about 0.5% by weight calcium ion;

b) from about 1.0% to about 10.0% by weight surfactant containing carboxylic acid, hydroxyl groups, and combinations thereof, wherein the total of the two functionalities in the surfactant is greater than or equal to 2, and wherein the surfactant is selected from the group consisting of alkylpolyglucoside surfactant, amphoteric surfactant, polycarboxyl surfactant, polyhydroxyl surfactant and combinations thereof;

c) from about 0.5% to about 7% by weight alpha-hydroxy carboxylic acid; and d) from about 4% to about 25% by weight sodium hydroxide or potassium hydroxide.

2. The composition of claim 1, wherein the calcium ion is from soluble calcium salts.

3. The composition of claim 1, wherein the alpha-hydroxy carboxylic acid is a dicarboxylic acid.

4. The composition of claim 1, further comprising up to about 5% by weight nonionic surfactant.

5. The composition of claim 1, further comprising up to about 5% by weight solvent.

6. The composition of claim 1, further comprising up to about 5% by weight anionic surfactant.

7. The composition of claim 1, wherein the surfactant is an alkylpolyglucoside where alkyl is C6 to C18.

8. The composition of claim 1, wherein the surfactant is an amphoteric surfactant having one or two carboxylic groups and a carbon chain of at least 10 carbon atoms.

9. The composition of claim 1, wherein the surfactant is a polycarboxyl surfactant.

10. The composition of claim 1, wherein the surfactant is a polyhydroxyl surfactant.

11. The composition of claim 3, wherein the dicarboxylic acid is tartaric acid.

12. The composition of claim 4, wherein the nonionic surfactant is selected from the group consisting of alcohol alkoxylates, alkylphenol alkoxylates, amine oxides and combinations thereof.

13. The composition of claim 5, wherein the solvent is selected from the group consisting of alcohols, glycol ethers, hydrotropes and combinations thereof.

14. The composition of claim 6, wherein the anionic surfactant is selected from the group consisting of alkali metal salts of alkyl sulfates, alkyl ether sulfates wherein alkyl is at least C10 and the number of alkylene oxide groups is from 2 to 4, and combinations thereof.

15. A stable, alkaline cleaner composition comprising:

a) from about 0.2% to about 0.4% by weight calcium ion from soluble calcium salts;

b) from about 3% to about 7% by weight surfactant containing carboxylic acid, hydroxyl groups, and combinations thereof, wherein the total of the two functionalities in the surfactant is selected from the group consisting of alkylpolyglucoside surfactant, amphoteric surfactant, polycarboxyl surfactant, polyhydroxyl surfactant and combinations thereof;

c) from about 2% to about 4% by weight dicarboxylic acid; and d) from about 4% to about 25% by weight sodium hydroxide or potassium hydroxde.

16. The composition of claim 15, wherein the dicarboxylic acid is tartaric acid.

17. The composition of claim 15, further comprising up to about 5% by weight nonionic surfactant.

18. The composition of claim 15, further comprising up to about 5% by weight solvent.

19. The composition of claim 15, further comprising up to about 5% by weight anionic surfactant.

20. The composition of claim 15, wherein the surfactant is an alkylpolyglucoside where alkyl is C6 to C18.

21. The composition of claim 15, wherein the surfactant is an amphoteric surfactant having one or two carboxylic groups and a carbon chain of at least 10 carbon atoms.

22. The composition of claim 15, wherein the surfactant is a polycarboxyl surfactant.

23. The composition of claim 15, wherein the surfactant is a polyhydroxyl surfactant.

24. The composition of claim 17, wherein the nonionic surfactant is selected from the group consisting of alcohol alkoxylates, alkylphenol alkoxylates, amine oxides and combinations thereof.

25. The composition of claim 18, wherein the solvent is selected from the group consisting of alcohols, glycol ethers, hydrotropes and combinations thereof.

26. The composition of claim 19, wherein the anionic surfactant is selected from the group consisting of alkali metal salts of, alkyl sulfates, alkyl ether sulfates where alkyl is at least C10 and the number of alkylene oxide groups is from 2 to 4, and combinations thereof.

* * * * *